US005678692A

United States Patent [19]

Gratz

[11] Patent Number: 5,678,692

[45] Date of Patent: Oct. 21, 1997

[54] CORNER PROTECTOR

[75] Inventor: Jeffrey J. Gratz, Hartland, Wis.

[73] Assignee: Fibreform Containers, Inc., Germantown, Wis.

[21] Appl. No.: 648,428

[22] Filed: May 15, 1996

[51] Int. Cl.[6] ..... B65D 85/48

[52] U.S. Cl. ..... 206/453; 206/523; 206/592

[58] Field of Search ..... 206/521, 523, 206/586, 591–594, 453; 248/345.1

[56] References Cited

U.S. PATENT DOCUMENTS

| | | | |
|---|---|---|---|
| 3,404,827 | 10/1968 | Carmody . | |
| 3,482,759 | 12/1969 | Ortiz . | |
| 3,655,113 | 4/1972 | Carroll . | |
| 3,762,626 | 10/1973 | Dorsey . | |
| 3,870,152 | 3/1975 | Kaplan . | |
| 3,883,065 | 5/1975 | Presnick | 206/594 |
| 3,889,866 | 6/1975 | Keller . | |
| 3,955,677 | 5/1976 | Collingwood | 206/586 |
| 3,975,564 | 8/1976 | Jones . | |
| 3,994,433 | 11/1976 | Jenkins et al. . | |
| 4,063,702 | 12/1977 | Wilde et al. . | |
| 4,072,231 | 2/1978 | Helms . | |
| 4,244,471 | 1/1981 | Plante . | |
| 4,496,054 | 1/1985 | Koltun . | |
| 4,742,916 | 5/1988 | Galea | 248/345.1 |
| 4,838,427 | 6/1989 | Hurley . | |
| 4,851,286 | 7/1989 | Maurice . | |
| 4,877,673 | 10/1989 | Eckel et al. | 206/453 |
| 4,923,065 | 5/1990 | Ridgeway . | |
| 5,154,297 | 10/1992 | Farley . | |
| 5,175,041 | 12/1992 | Webb et al. . | |
| 5,184,748 | 2/1993 | Apps | 206/503 |
| 5,267,651 | 12/1993 | Hughes . | |
| 5,287,966 | 2/1994 | Stahl | 206/503 |
| 5,518,118 | 5/1996 | Putz et al. | 206/586 |

FOREIGN PATENT DOCUMENTS

| | | | |
|---|---|---|---|
| 2081678 | 2/1982 | United Kingdom | 206/586 |

*Primary Examiner*—Paul T. Sewell
*Assistant Examiner*—Nhan T. Lam
*Attorney, Agent, or Firm*—Andrus, Sceales, Starke & Sawall

[57] ABSTRACT

A corner protector is provided for protecting a product during shipment. The corner protector is formed by first, second, and third perpendicular intersecting sidewalls. Each sidewall includes an inner surface which together form a product engaging surface on one side of the corner protector. One or more recessed channels are formed along the product engaging surface in one or more corresponding planes which are perpendicular to one of the sidewalls of the corner protector. The recessed channels optimize the strength and flexibility of the corner protector.

23 Claims, 2 Drawing Sheets

FIG. 5
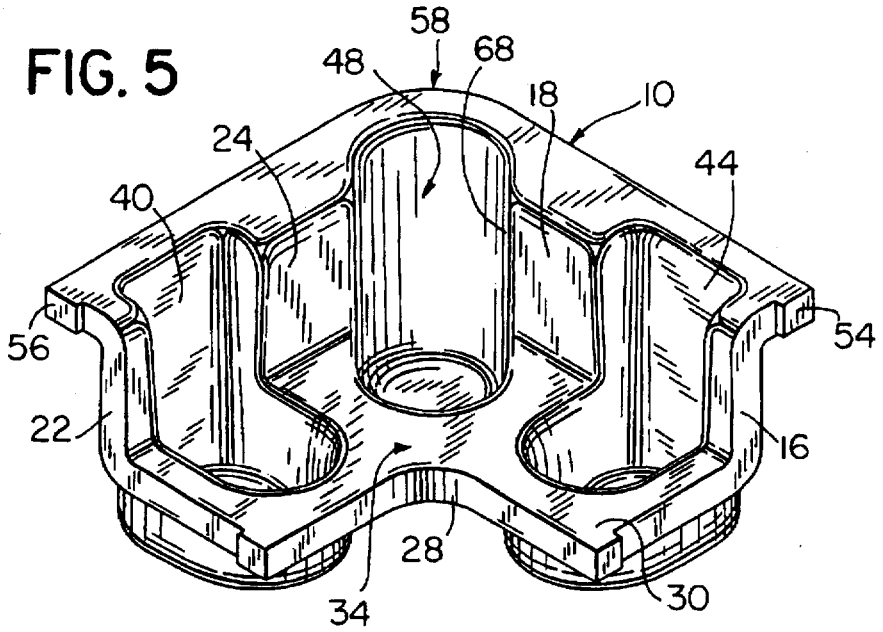
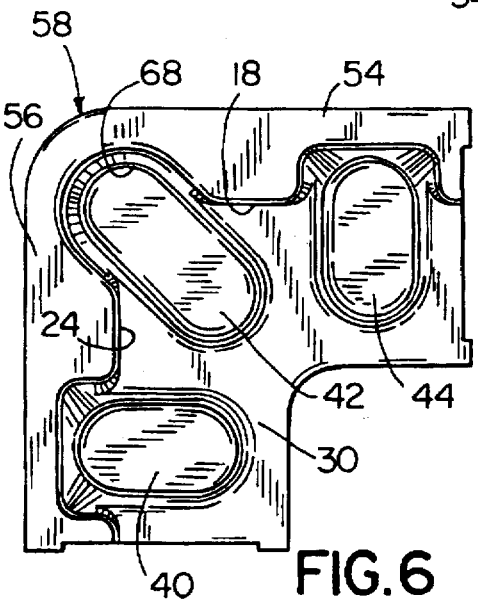
FIG. 6
FIG. 7
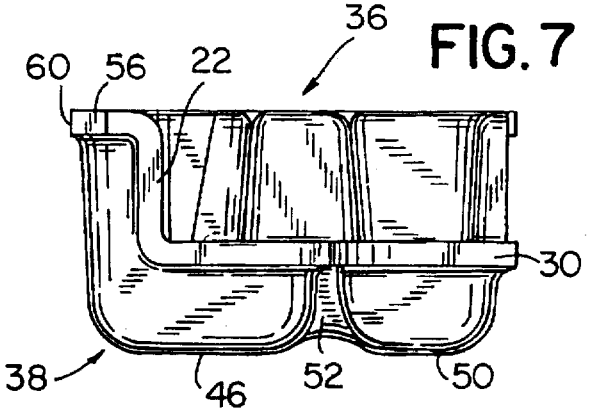
FIG. 9
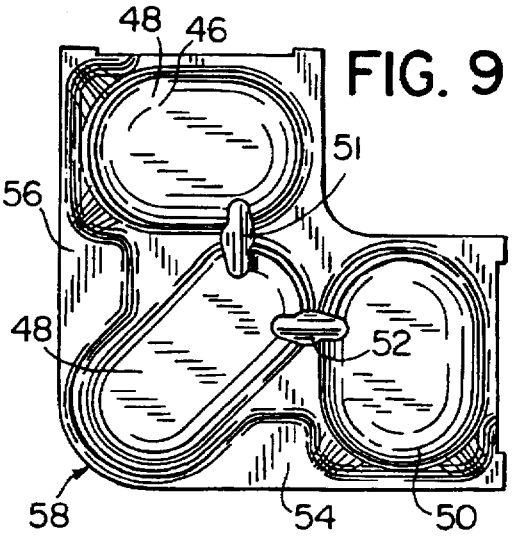
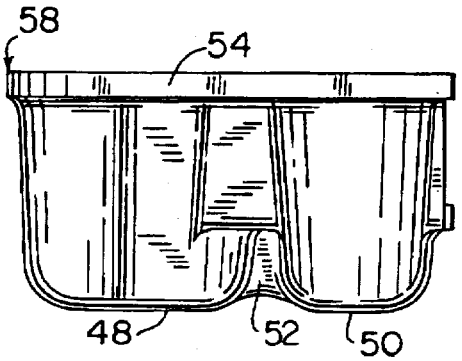
FIG. 8

CORNER PROTECTOR

BACKGROUND AND SUMMARY OF THE INVENTION

The present invention relates to corner protectors, in particular, to a corner protector with optimized strength and flexibility to protect the corner of an object in a carton or the like during shipment.

Heretofore, a wide variety of corner protectors have been manufactured to protect the corners of an object during shipment. However, prior art corner protectors have significant drawbacks which limit their use and/or effectiveness. As such, it is highly desirable to develop a corner protector which overcomes these drawbacks.

Prior art expanded polystyrene corner protectors are often perceived to be environmentally unfriendly. As is known, expanded polystyrene is not biodegradable and hence, may be banned from landfills or the like. Further, many insurance companies refuse to allow their client's to store expanded polystyrene in factories and warehouses due to fire related concerns. As such, user's of corner protectors have sought a more environmentally sound alternative to the expanded polystyrene protectors.

To address environmental concerns, corner protectors formed from molded pulp have been developed. However, these molded pulp corner protectors often times do not have sufficient strength to protect the corner of the object. Further, due to the substantial flexibility of the products formed from molded pulp, molded pulp corner protectors tend to be too flexible thereby compromising the amount of protection for the corner of the object.

In order to increase the strength and reduce the flexibility of molded pulp corner protectors, ribs or depressions have been molded into the corner protectors. These ribs increase the strength and reduce the flexibility of the molded pulp corner protector. However, heretofore to obtain a corner protector having sufficient strength, a plurality of intersecting depressions or ribs must be molded into the corner protector. As a result, the flexibility of the corner protector also increases, rendering an inferior product.

Therefore, it is a primary object and feature of the present invention to provide a molded pulp corner protector which optimizes strength and flexibility in order to protect the corner of an object during shipment.

It is a further object and feature of the present invention to provide a corner protector which is simple to mold, and inexpensive to manufacture.

It is a still further object and feature of the present invention to provide a corner protector which is biodegradable and hence, environmentally friendly.

In accordance with the present invention, corner protector is provided for protecting a product during shipment. The corner protector includes the first sidewall extending along a first plane and having a first sidewall inner surface. A second sidewall extends along a second plane perpendicular to the first plane and has a second sidewall inner surface. A third sidewall extending along a third plane perpendicular to the first plane and perpendicular to the second plane, and having a third sidewall inner surface is also provided. The first, the second and the third sidewalls are interconnected such that the first sidewall inner surface, the second sidewall inner surface and a third sidewall inner surface intersect.

A product engaging surface is formed by the intersection of first, second, and third sidewall inner surfaces on the first inner side of the corner protector. The product engaging surface includes a recessed channel formed therein along a fourth plane perpendicular to the third plane. The first sidewall, the second sidewall and the third sidewall each include an outer sidewall surface. The intersection of the first sidewall outer surface, the second sidewall outer surface, and the third sidewall outer surface forms a second, opposite side of the corner protector. The recessed channel forms a generally planar support surface along the second side of the corner protector. The generally planar support surface is generally parallel to the third sidewall inner surface.

Second and third recessed channels may be formed in the product engaging surface along fifth and sixth planes, respectively, each of which is perpendicular to the third plane. Each of these recessed channels forms an additional generally planar surface along the second side of the corner protector. Each of these generally planar support surfaces lie in a single plane.

A lip or flange extends laterally from both the first and the second sidewalls in a plane parallel to and vertically spaced from the third plane. The flanges are joined so as to form a corner of the corner protector. In a preferred embodiment, the corner formed by the joinder of the first and second flanges is rounded in order to space the corner of the corner protector away from the carton in which the object is shipped. Hence, the crushing of the corner of the carton does not damage the corner of the corner protector.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 5 is an isometric view of the corner protector of the present invention;

FIG. 6 is a top plan view of the corner protector of the present invention;

FIG. 7 is a side elevational view of the corner protector of the present invention;

FIG. 8 is a second side elevational view of the opposite side of the corner protector of the present invention; and FIG. 9 is a bottom plan view of the corner protector of the present invention.

DETAILED DESCRIPTION OF THE PREFERRED EMBODIMENT

Figure 1:
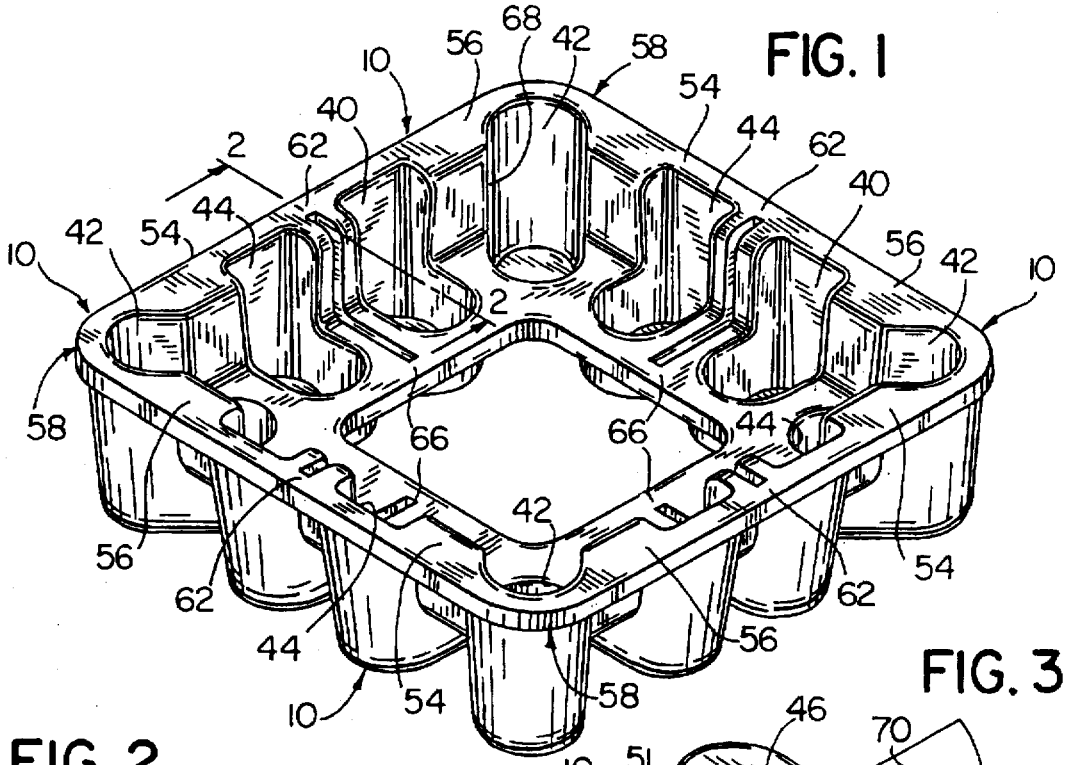
FIG. 1 is an isometric view of a protective packaging member incorporating the corner protector of the present invention.
Figure 2:
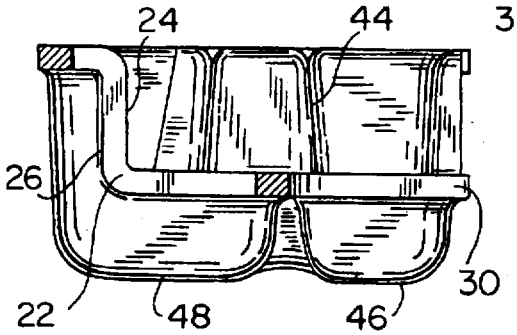
FIG. 2 is a side elevational view of the corner protector of the present invention.
Figure 3:
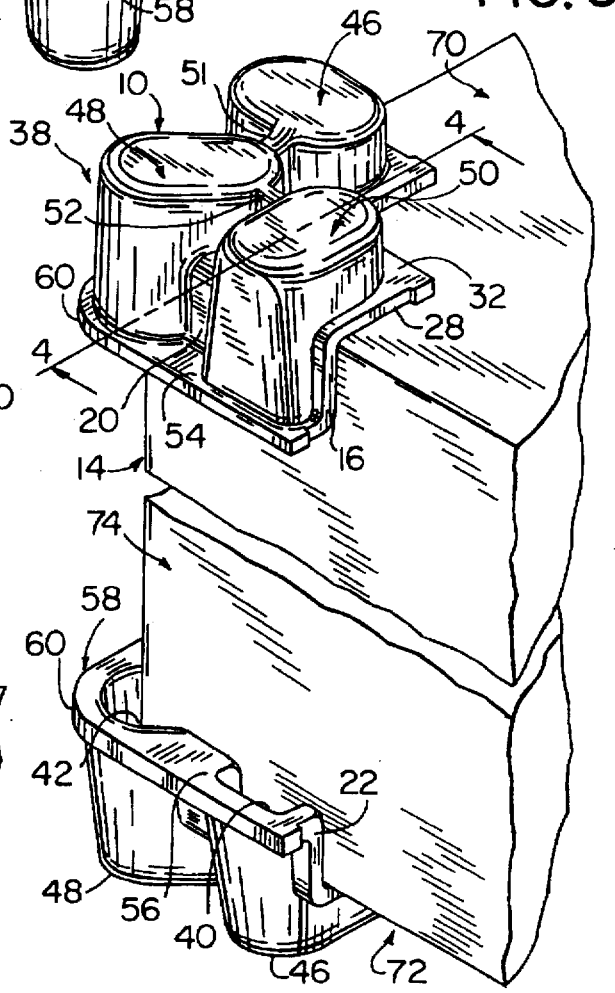
FIG. 3 is an isometric view of a first and a second corner protector of the present invention placed over the distinct corners of an object.
Figure 4:
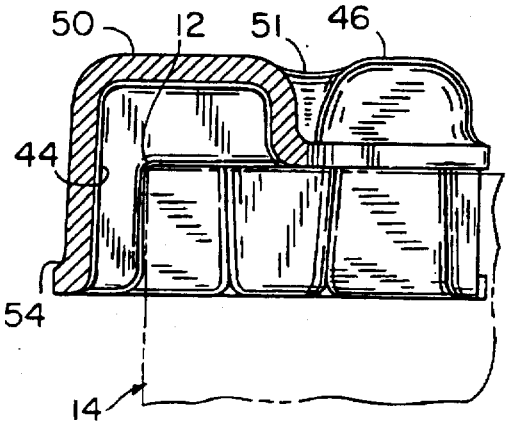
FIG. 4 is a cross-sectional view of the corner protector of the present invention taken along line 4—4 of FIG. 3.

Referring to FIG. 5, corner protector corresponding to the present invention is generally designated by the reference numeral 10. As best seen in FIGS. 3–4, corner protector 10 is designed to surround a corner 12 of an object 14 in order to protect corner 12 during shipment.

Corner protector 10 includes a first sidewall 16 extending along a first plane and having an inner surface 18 and an outer surface 20. A second sidewall 22 extends along a second plane perpendicular to the first plane and has an inner surface 24 and an outer surface 26.

A third sidewall 28 extends along a third plane perpendicular to the first plane and perpendicular to the second plane. The third sidewall includes an inner surface 30 and outer surface 32. The first, the second, and the third sidewalls 16, 22 and 28, respectively, are integrally molded such that the inner surface of the first sidewall, the inner surface of the second sidewall, and the inner surface of the third sidewall intersect to form a product engaging surface 34 on a first side 36 of corner protector 10.

Similarly, the outer surface of the first sidewall, the outer surface of the second sidewall, and the outer surface of the third sidewall 20, 26 and 32, respectively, intersect to form a second, opposite side 38 of corner protector 10.

First 40, second 42 and third 44 recess channels are formed in the product engaging surface 34 on a first side 36 of corner protector 10. Each recessed channel 40, 42 and 44 lie in distinct planes each of which being perpendicular to the third sidewall 28 of corner protector 10. In addition, each recessed channel 40, 42 and 44 forms a corresponding, generally planar support surface 46, 48 and 50, respectively, on the second, opposite side 38 of corner protector 10. In a preferred embodiment, each generally planar support surface 46, 48 and 50 lie in a single plane, generally parallel to the inner surface 30 of the third sidewall 28.

Support surfaces 46 and 48 are interconnected on the second side 38 of corner protector 10 by a bridge 50 formed therebetween. The height and the width of the bridge 50 may be varied in order to vary the strength and flexibility characteristics of corner protector 10. A bridge 50 of greater height or width, reduces the overall flexibility of corner protector 10. On the other hand, by reducing the height and/or width of bridge 50, the corner protector 10 becomes more flexible and hence, has increased cushioning properties.

Similarly, a second bridge 52 is formed between support surfaces 48 and 50. As previously described with respect to bridge 50, the flexibility characteristics of corner protector 10 may be modified by varying the height and/or width of bridge 52.

A first flange 54 extends laterally from first sidewall 16 of corner protector 10. Similarly, a second flange 56 extends laterally from second sidewall 22 of corner protector 10. First and second flanges 54 and 56 lie in a single plane and are joined to form a corner 58. In the preferred embodiment, corner 58 is round for reasons hereinafter noted. Flanges 54 and 56 terminate at an outer edge 60.

For economics of scale, four corner protectors 10 may be molded as a single integral unit from molded pulp or other suitable material such as expanded polystyrene or the like. In addition, it may be cost effective to mold the corner protectors 10 with a single mold. When integrally molded, each corner protector 10 is interconnected to the adjacent corner protector by a first snap joint 62 formed between the first flange 54 on corner protector 10 and the second flange 56 on the adjacent corner protector. A second snap joint 66 is formed between the third sidewall 28 on each adjacent corner protector. After molding, snap joints 62 and 66 may be broken so as to separate each corner protector 10 from the adjacent corner protector.

In operation, the corner protector 10 is placed over a corner 12 of an object 14 such that the product engaging surface 34 engages object 14. Corner 12 of object 14 is received within recessed channel 42. Channel 42 has sufficient depth such that corner 12 does not engage the inner peripheral surface 68 of channel 42. As best seen in FIG. 3, support surfaces 46, 48, and 52 may be positioned about the lower corner of an object 14 so as to support object 14 on a horizontal surface.

Corner protector 10 is adapted for positioning about the corners of object 14 when object 14 is received within a carton or box for shipment or the like. With object 14 received within a carton, support surfaces 46, 48 and 50 engage the corresponding upper or inner horizontal surface of the carton so as to space the upper 70 or lower 72 surface of object 14 from the top and bottom of the carton. Outer edge 60 of each corner protector 10 vertically aligns object 14 within the carton and separates the faces 74 of object 14 from the vertical sidewalls of the shipping carton. Rounded corner 58 of corner protector 10 provides lateral spacing between corner protector 10 and a corner of the shipping carton. This, in turn, prevents damage to the corner protector in response to crushing of the vertical edges of the shipping carton.

Various modes of carrying out the invention are contemplated as being within the scope of the following claims particularly pointing out and distinctly claiming the subject matter which is regarded as the invention.

I claim:

1. A corner protector for protecting a corner of a product during shipment, comprising:

a first sidewall extending along a first plane and having a first sidewall inner surface;

a second sidewall extending along a second plane perpendicular to the first plane and having a second sidewall inner surface;

a third sidewall extending along a third plane perpendicular to the first plane and perpendicular to the second plane, and having a third sidewall inner surface, the first, the second, and the third sidewalls interconnected such that the first sidewall inner surface, the second sidewall inner surface, and the third sidewall inner surface intersect; and a product engaging surface formed by the intersecting first, second, and third sidewall inner surfaces on a first inner side of the corner protector, the product engaging surface including a recessed channel formed therein along a fourth plane perpendicular to the third plane, the recessed channel extending along the intersection of the first and second sidewall inner surfaces and continuing along the third sidewall inner surface.

2. The corner protector of claim 1 wherein the first sidewall includes a first sidewall outer surface.

3. The corner protector of claim 2 wherein the second sidewall includes a second sidewall outer surface.

4. The corner protector of claim 3 wherein the third sidewall includes a third sidewall outer surface wherein the first sidewall outer surface, the second sidewall outer surface, and the third sidewall outer surface intersect and form a second, opposite side of the corner protector.

5. The corner protector of claim 4 wherein the recessed channel forms a generally planar support surface along the second side of the corner protector, the generally planar support surface being generally parallel to the third sidewall inner surface.

6. The corner protector of claim 5 wherein the product engaging surface includes a second recessed channel formed along a fifth plane, perpendicular to the third plane, the second recessed channel extending along the second sidewall inner surface and continuing along the third sidewall inner surface.

7. The corner protector of claim 6 wherein the second recessed channel forms a second generally planar support surface along the second side of the corner protector, the second generally planar support surface generally parallel to the third sidewall inner surface.

8. The corner protector of claim 7 further comprising a bridge formed along the second side of the corner protector, the bridge interconnecting the first generally planar support surface and the second generally planar support surface.

9. The corner protector of claim 7 wherein the first generally planar support surface and the second generally planar support surface lie in the same plane.

10. The corner protector of claim 7 wherein the product engaging surface includes a third recessed channel formed along a sixth plane, perpendicular to the third plane, the third recessed channel extending along the first sidewall inner surface and continuing along the third sidewall inner surface.

11. The corner protector of claim 10 wherein the third recessed channel forms a third generally planar support surface being generally parallel to the third sidewall inner surface.

12. The corner protector of claim 10 further comprising a bridge formed along the second side of the corner protector, the bridge interconnecting the second generally planar support surface and the third generally planar support surface.

13. The corner protector of claim 12 wherein the first generally planar support surface, the second generally planar support surface, and the third generally planar support surface lie in the same general plane.

14. The corner protector of claim 12 wherein the flange includes a first flange portion extending from the first sidewall and a second flange portion extending from the second sidewall, the first and second flange portions being jointed to form a corner.

15. The corner protector of claim 14 wherein the corner formed by the joinder of the first and the second flange portions is rounded.

16. The corner protector of claim 1 further comprising a flange interconnected to and extending laterally from the first and the second sidewall in a plane parallel to and vertically spaced from the third plane.

17. A corner protector for protecting a corner of a product during shipment, comprising:

a first sidewall extending along a first plane and having a first sidewall inner surface and a first sidewall outer surface;

the second sidewall extending along a second plane perpendicular to the first plane and having a second sidewall inner surface and a second sidewall outer surface;

a third sidewall extending along a third plane perpendicular to the first plane and perpendicular to the second plane, and having a third sidewall inner surface, the first, the second, and the third sidewalls interconnected such that the first sidewall inner surface, the second sidewall inner surface, and the third sidewall inner surface intersect, the third sidewall further having a third sidewall outer surface wherein the first sidewall outer surface, the second sidewall outer surface, and the third sidewall outer surface intersect and form a second, opposite side of the corner protector;

a product engaging surface formed by the intersecting first, second, and third sidewall inner surfaces on a first inner side of the corner protector, the product engaging surface including a recessed channel formed therein along a fourth plane perpendicular to the third plane, the recessed channel forming a first, generally planar support surface along the second side of the corner protector, the first, generally planar support surface being generally parallel to the third sidewall inner surface, the product engaging surface further including a second recessed channel formed along a fifth plane, perpendicular to the third plane, the second recessed channel forms a second generally planar support surface along the second side of the corner protector, the second generally planar support surface generally parallel to the third sidewall inner surface, and the product engaging surface further including a third recessed channel formed along a sixth plane, perpendicular to the third plane, the third recessed channel forms a third generally planar support surface being generally parallel to the third sidewall inner surface; and a bridge formed along the second side of the corner protector, the bridge interconnecting the second generally planar support surface and the third generally planar support surface.

18. The corner protector of claim 17 further comprising a second bridge formed along the second side of the corner protector, the bridge interconnecting the first generally planar support surface and the second generally planar support surface.

19. The corner protector of claim 17 wherein the first generally planar support surface and the second generally planar support surface lie in the same plane.

20. The corner protector of claim 17 wherein the first generally planar support surface, the second generally planar support surface, and the third generally planar support surface lie in the same general plane.

21. The corner protector of claim 17 further comprising a flange interconnected to and extending laterally from the first and the second sidewall in a plane parallel to and vertically spaced from the third plane.

22. The corner protector of claim 17 wherein the flange includes a first flange portion extending from the first sidewall and a second flange portion extending from the second sidewall, the first and second flange portions being joined to form a corner.

23. The corner protector of claim 22 wherein the corner formed by the joinder of the first and the second flange portions is rounded.

* * * * *